US006514571B1

(12) United States Patent
Piccinino, Jr. et al.

(10) Patent No.: US 6,514,571 B1
(45) Date of Patent: Feb. 4, 2003

(54) METHOD AND APPARATUS FOR APPLYING A SOLUTION TO PHOTOSENSITIVE MATERIAL

(75) Inventors: Ralph L. Piccinino, Jr., Rush, NY (US); Kevin H. Blakely, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 458 days.

(21) Appl. No.: 09/082,957

(22) Filed: May 21, 1998

(51) Int. Cl.[7] ..... B05D 1/28
(52) U.S. Cl. ..... 427/428; 427/211; 118/249
(58) Field of Search ..... 118/249, 261, 118/267; 396/608, 606; 427/211, 428

(56) References Cited

U.S. PATENT DOCUMENTS 4,135,475 A 1/1979 Bomers
4,327,987 A * 5/1982 Friar et al. ..... 118/412
4,929,975 A 5/1990 Shidara
5,318,804 A 6/1994 Yoshida
5,641,544 A * 6/1997 Melancon et al. ..... 427/331
5,687,419 A 11/1997 Earle et al.
5,690,999 A 11/1997 Rantanen
5,752,121 A 5/1998 Earle et al.
5,839,011 A * 11/1998 Urasaki et al. ..... 396/608

* cited by examiner

*Primary Examiner*—Katherine A. Bareford
(74) *Attorney, Agent, or Firm*—Frank Pincelli

(57) ABSTRACT

An apparatus and method for applying a solution having a predetermined viscosity to a photosensitive material, such as a photographic print, involves the conveyance of the photosensitive material through a tank. A guide member mounted in the tank is effective to guide viscous solution to an area in the vicinity of a nip portion between first and second rollers. This arrangement creates at least one bead in a vicinity of the nip portion between the rollers so as to promote an even and consistent application of solution to the photosensitive material, and at the same time, permits an upper roller of the drive rollers to stay evenly wet.

13 Claims, 4 Drawing Sheets

METHOD AND APPARATUS FOR APPLYING A SOLUTION TO PHOTOSENSITIVE MATERIAL

FIELD OF THE INVENTION

The present invention relates to the photoprocessing and/or photofinishing field. More particularly, the present invention relates to a method and apparatus for applying a solution of a predetermined viscosity to photosensitive material, preferably processed photosensitive material, to form a protective overcoat on at least one surface of the photosensitive material.

BACKGROUND OF THE INVENTION

In order to apply a protective coating to an emulsion surface of a photosensitive material, control over the thickness, uniformity and lay down amount of the coating being applied is needed in order to provide for adequate protection against moisture and scratches. The control is needed for several reasons: 1) the protective coating must be applied in a manner that insures that the surface is uniformly coated so that the coating can provide adequate protection to the entire surface; 2) that thickness of the coating must be controlled because if the coating is too thick, it could cause cracking, due to non-uniform drying; 3) a thick coating could dull the surface and the underlying image of photographic print; and 4) the coating solutions can be of different viscosities.

U.S. Pat. No. 5,318,804 discloses a coater for applying a liquid onto a surface of a moving object. In the coater of U.S. Pat. No. 5,318,804, a coating liquid is applied onto a coating roll which transports the coating liquid onto a supporter that is positioned on a backup roll. A drawback of the coater of U.S. Pat. No. 5,318,804 is that no provision is made for assuring that the coating liquid is guided to and kept at a nip portion between the rolls, so as to provide for an even application of coating liquid and to maintain the rolls in a wet state.

U.S. Pat. No. 5,690,999 discloses a coating device for the coating of a size-press roll, paper or board. This patent discloses a revolving coating bar which rests against a press roller. Like the arrangement shown in U.S. Pat. No. 5,318,804, the arrangement of U.S. Pat. No. 5,690,999 also does not provide for a mechanism for guiding and keeping coating liquid at a vicinity of a nip portion between rollers, so as to assure a uniform application of coating liquid and to maintain the rolls in a wet state.

SUMMARY OF THE INVENTION

The present invention provides for a novel method and apparatus which can apply a solution of a predetermined viscosity to the surface of photosensitive material, preferably processed photosensitive material, prior to the final drying of the material to form a protective overcoat. In the present invention, the solution is applied a manner that allows the solution to be uniformly applied to the surface of the photosensitive material at a specific thickness.

With the method and apparatus of the present invention, a solution of predetermined viscosity is guided to a vicinity of a nip portion between two drive rollers by a solution supply guide member. The arrangement of the present invention assures that at least an upper roller of the drive rollers is maintained wet with the solution, and also provides for the formation of a bead of solution in a vicinity of the nip portion, so as to promote a consistent and even application of solution to photosensitive material that is guided between the drive rollers.

The present invention relates to a method of applying at least one solution of a predetermined viscosity to photosensitive material. The method comprises the steps of providing a solution supply guide member at a position relative to first and second rollers, such that one end of the guide member extends toward a nip portion between the first and second rollers; supplying a solution of a predetermined viscosity onto the guide member so that the solution flows along the guide member and is guided toward the nip portion between the first and second rollers, so as to form at least one bead of the solution; and conveying a photosensitive material toward the nip portion, such that the solution is applied to the surface of a photosensitive material.

The present invention also relates to an apparatus for applying at least one solution of a predetermined viscosity to photosensitive material. The apparatus comprises first and second rollers rotatably mounted in a tank so as to define a nip portion therebetween; a solution supply guide member positioned relative to the first and second rollers such that one end of the guide member extends toward the nip portion; and a solution supply port for introducing a solution of a predetermined viscosity onto the guide member, such that the solution flows along the guide member and is guided toward the nip portion to form at least one bead of the solution.

The present invention also relates to a method of applying at least one solution of a predetermined viscosity to photosensitive material which comprises the steps of providing a solution supply guide member at a position relative to first and second rollers so that one end of the guide member extends toward a nip portion between the first and second rollers; supplying a solution of a predetermined viscosity onto one of the first and second rollers, such that the solution flows along an outer peripheral surface of the one of the first and second rollers in a direction toward the one end of the guide member, and is guided by the guide member toward the nip portion, wherein the solution guided by the guide member toward the nip portion forms a bead in a vicinity of the nip portion; and conveying a photosensitive material toward the bead and into the nip portion, such that the solution is applied to the photosensitive material.

The present invention further relates to an apparatus for applying at least one solution of a predetermined viscosity to photosensitive material which comprises first and second rollers rotatably mounted in a tank so as to define a nip portion therebetween; a solution supply guide member positioned relative to the first and second rollers such that the one end of the guide member extends toward the nip portion; and a solution supply port for introducing solution of a predetermined viscosity onto one of the first and second rollers, such that the solution flows along an outer peripheral surface of the one of the first and second rollers in a direction toward the one end of the guide member, wherein the guide member guides the solution toward the nip portion and the solution forms a bead in a vicinity of the nip portion.

The present invention also relates to an apparatus for applying at least one solution of a predetermined viscosity to photosensitive material which comprises first and second rollers mounted in a tank so as to define a nip portion therebetween; a solution supply guide member positioned relative to the first and second rollers such that one end of the guide member extends toward the nip portion; and a solution supply port for introducing a solution of a predetermined viscosity into the tank, such that the guide member guides the solution toward the nip portion and the solution forms a bead in a vicinity of the nip portion.

The present invention also relates to a photoprocessing system which comprises a processor for processing photosensitive material; and a coating apparatus for applying at least one solution of a predetermined viscosity to the processed photosensitive material. The coating apparatus includes first and second rollers mounted in a tank so as to define a nip portion therebetween; a solution supply guide member positioned relative to the first and second rollers such that one end of the guide member extends toward the nip portion; and a solution supply port for introducing a solution of a predetermined viscosity into the tank, such that the guide member guides the solution toward the nip portion and the solution forms a bead in a vicinity of the nip portion.

DETAILED DESCRIPTION OF THE INVENTION

Figure 1:
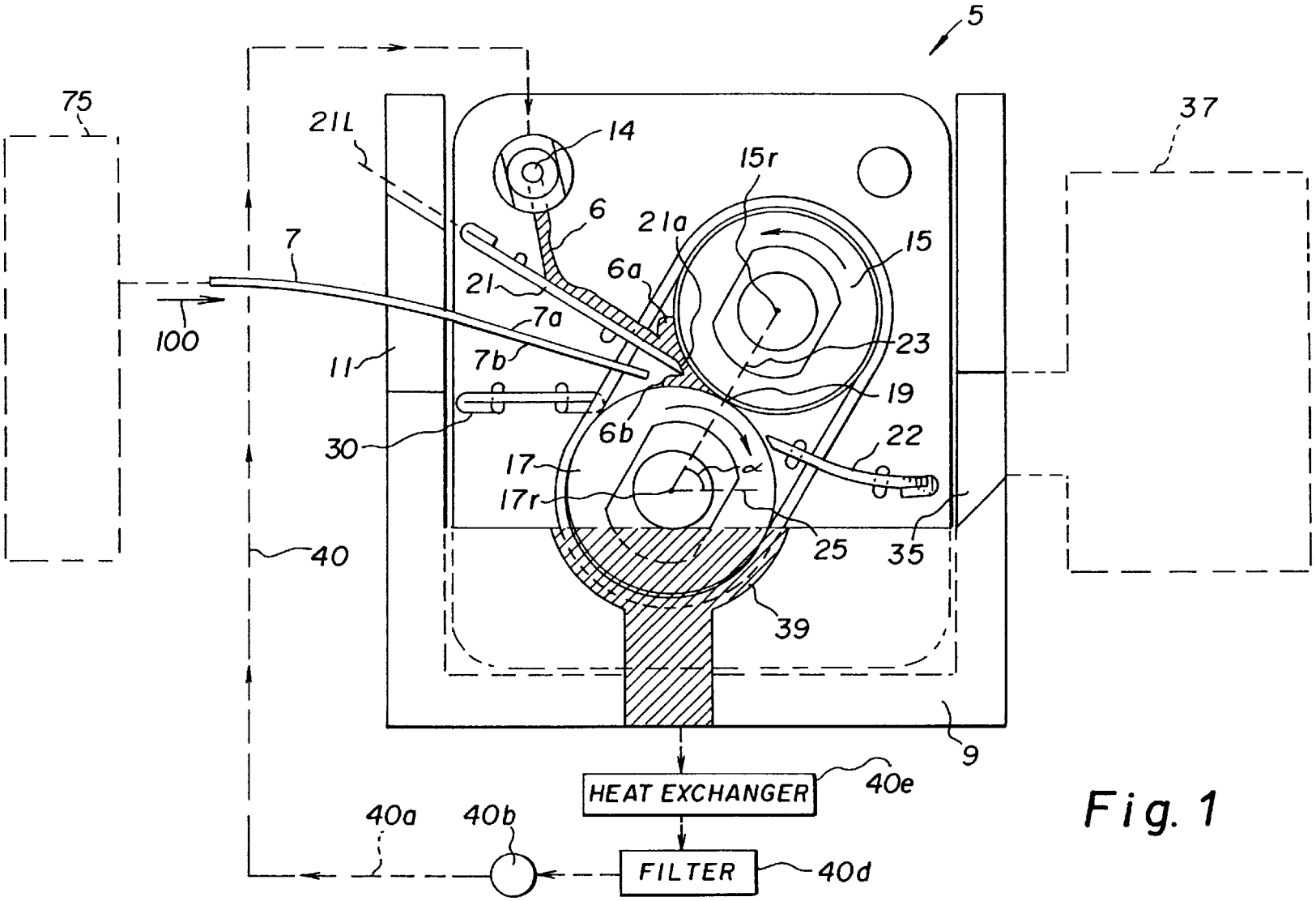
FIG. 1 is a schematic illustration of a first example of the apparatus of the present invention.

Referring now to the drawings, wherein like references numerals represent identical or corresponding parts throughout the several views, FIG. 1 illustrates a coating apparatus 5 for applying a layer of solution 6 of a predetermined viscosity to photosensitive material 7 prior to the drying of photosensitive material 7. Photosensitive material 7 can be a processed photosensitive material and can be in the form of a photographic print, a web, cut sheet or film. Viscous solution 6 when dried will form a protective coating on photosensitive material 7 which exhibits moisture-proof and scratch-proof properties. Coating apparatus 5 can be added to the end of an existing processing device as an accessory, can be built in as part of a new processor, or retrofit into an existing processor.

With respect to the properties of viscous solution 6, reference is made to applications U.S. Ser. No. 08/965,560, now U.S. Pat. No. 5,984,539, U.S. Ser. No. 08/965,639, now U.S. Pat. No. 5,905,924, and U.S. Ser. No. 08/965,105, now U.S. Pat. No. 5,875,370, the subject matter of which is herein incorporated by reference. Since solution 6 is to be applied in a minilab or photographic processing center, water-based solutions that are substantially free of volatile organic compounds are preferred. It is recognized that numerous viscous solutions can be utilized and that the type of viscous solution applied is based on design considerations in view of the desired viscosity, water-proofing and scratch-proof properties of the applied coating.

Apparatus 5 comprises a tank 9 which can be in the form of a solution pan that includes a photosensitive material entry port 11 as well as a viscous solution entry port 14. Mounted within tank 9 in a rotatable manner are first and second drive rollers 15, 17. Roller 15 is preferably a metering roller and roller 17 is preferably a pinch roller. Rollers 15 and 17 are mounted within tank 9 so as to define a nip portion 19 therebetween for the passage of photosensitive material 7.

Tank 9 further includes a solution supply guide member 21 which is mounted at an angle with respect to a horizontal line and includes an end 21 a that is approximately located in an area between first and second rollers 15, 17 and at a vicinity of nip portion 19.

Figure 2:
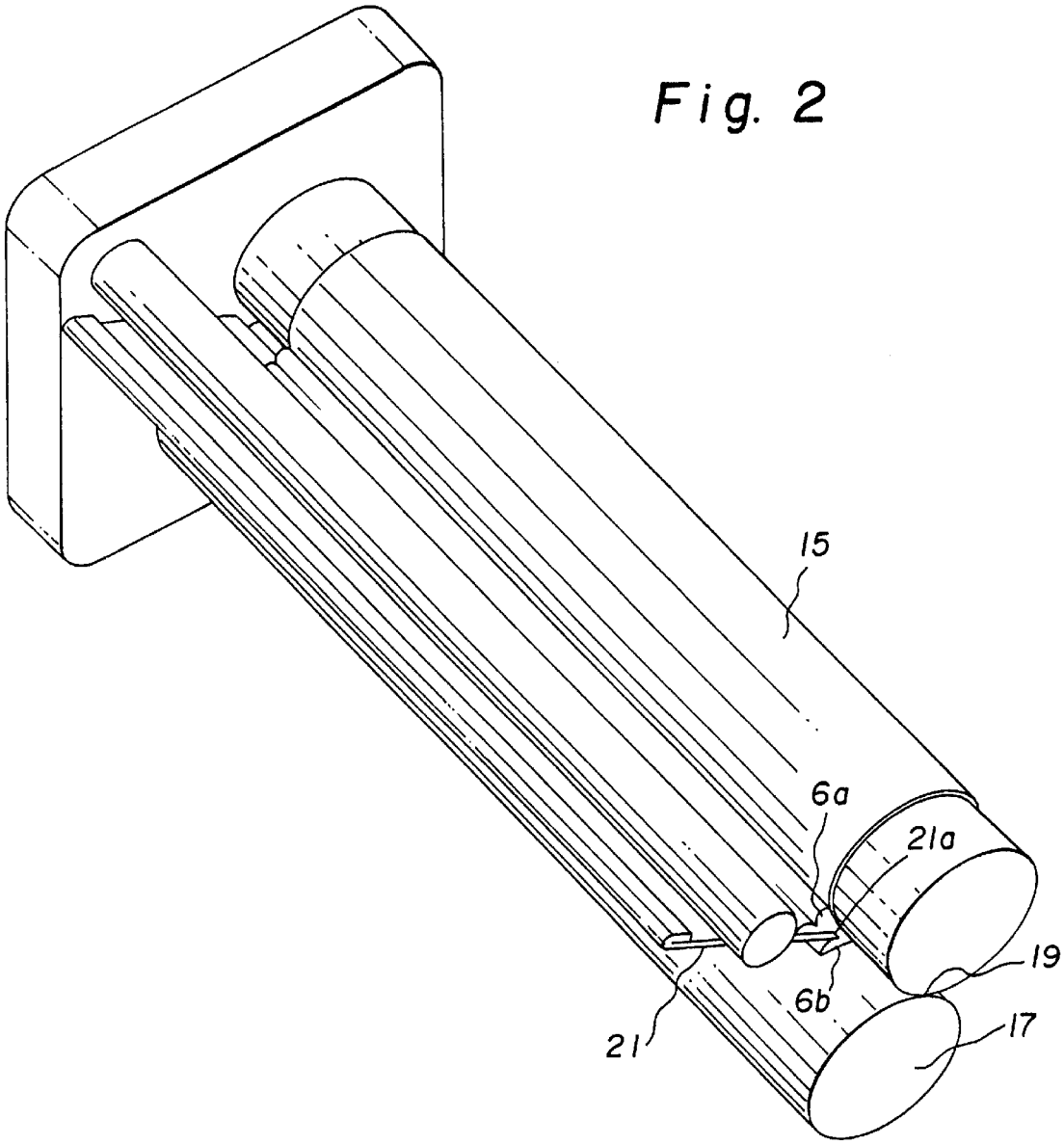
FIG. 2 is an isolated view of a solution supply guide member and drive rollers of the apparatus of FIG. 1.

As illustrated in FIG. 1, rollers 15 and 17 are mounted in a slanted manner within tank 9. More specifically, rollers 15 and 17 are mounted such that a center line 23 which connects a center of rotation 15*r* of roller 15 to a center of rotation 17*r* of roller 17 makes an approximately 30° angle $\alpha$ with a horizontal line 25. Also, guide member 21 includes a longitudinal axis 21L which makes an approximately 90° angle with center line 23. With this specific arrangement, as solution 6 is introduced onto guide member 21 by way of entry port 14, solution 6 will flow along guide member 21 in the manner illustrated in FIG. 1. As shown in FIGS. 1 and 2, guide member 21 guides solution 6 onto drive roller 15 such that solution 6 forms a first bead 6*a* that extends above guide member 21 and between guide member 21 and an outer peripheral surface of roller 15. Guide member 21 also causes solution 6 to form a second bead 6*b* in the vicinity of nip portion 19 which extends below guide member 21 and between guide member 21 and an outer peripheral surface of roller 17. It is recognized that the present invention is not limited to the angles described above with respect to the positioning of rollers 15, 17 and guide member 21. These angles could be varied depending on design considerations such as, for example, the type or viscosity of solution 6.

The positioning of guide member 21 so that end 21*a* extends to a vicinity of nip portion 19 in the manner shown in FIG. 1, as well as the isolated view of FIG. 2, permits the formation of first and second beads 6*a*, 6*b* as described above. With this arrangement, bead 6*a* deposited on the outer peripheral surface of roller 15 assures that roller 15 is maintained in a wet state by solution 6; while bead 6*b* formed in the vicinity of nip portion 19 assures that solution 6 is maintained at nip portion 19 and that photosensitive material introduced through entry port 11 will be evenly coated by solution which forms bead 6*b*. That is, the specific orientation of rollers 15, 17 and guide member 21 as illustrated in FIGS. 1 and 2, assures that solution 6 flowing along guide member 21 forms beads 6*a*, 6*b*, and also assures the maintenance of solution at nip portion 19.

Therefore, with the use of coating apparatus 5 as illustrated in FIG. 1, photosensitive material 7, such as processed photosensitive material, exits the last station of a processing assembly 75 and is introduced into apparatus 5 by way of entry port 11. Processing assembly 75 of a processing system could be a known arrangement which includes a series of tanks that include developer solution, bleach solution, fixer solution and washing solution; or a combination of bleach-fix solution and a wash/stabilizer solution. Each of the tanks would thereby represent steps in the developing process. After entering coating apparatus 5, photosensitive material 7 is guided by the combination of the guide 30 and guide member 21 into nip portion 19 between rollers 15 and 17. Viscous solution 6 is applied by way of entry port 14 onto guide member 21 and flows along guide member 21 so as to form first bead 6a and second bead 6*b* as shown. First bead 6*a* extends along the outer peripheral surface of drive roller 15 so as to assure that drive roller 15 is maintained wet with solution 6. Second bead 6*b* formed in the vicinity of nip portion 19 is located in front of nip portion 19 with respect to a conveying direction 100 of photosensitive material 7. With this arrangement, photosensitive material 7 introduced into nip portion 19 will first flow into second bead 6*b* and be coated with viscous solution 6 as photosensitive material 7 passes nip portion 19.

As described above, drive roller 15 can be a metering roller which meters viscous solution 6 applied to surface 7*a* of photosensitive material 7 as photosensitive material 7 passes through nip portion 19. Metering roller 15 could be, for example, a known wire wrapped roller bar that can be set across photosensitive material 7 and applied against solution 6 coated on photosensitive material 7. Metering roller 15 removes a desired amount of solution 6 in a controlled manner and leaves a desired thickness of solution 6 on photosensitive material 7. Roller 17 which can be a pinch roller serves to remove excess solution from opposite surface 7*b* of photosensitive material 7, and with roller 15 drives photosensitive material 7 through nip portion 19. As photosensitive material 7 leaves nip portion 19, a guide bar 22 positioned downstream of nip portion 19 serves to guide photosensitive material 7 to exit 35, and if desired, can aid in scraping any further excess viscous solution from surface 7*b* of photosensitive material 7.

After photosensitive material 7 having side 7*a* coated with viscous solution 6 leaves apparatus 3 via exit 35, it can thereafter enter a dryer 37 schematically illustrated in FIG. 1. Dryer 37 can be a known dryer which dries photosensitive material 7 by way of, for example, air blowers as described in copending applications U.S. Ser. Nos. 08/965,560, 08/965,639 and 08/965,105. As an alternative feature and based on design considerations, photosensitive material 7 can be first lead to, for example, a curing mechanism and thereafter a dryer or visa versa.

Also, as shown in FIG. 1, tank 9 can include a trough 39 into which roller 17 is partially submerged. Trough 39 collects solution 6 as it flows downward and leads solution 6 to a recirculation assembly 40. Recirculation assembly 40 can include a pump 40*b* positioned in a conduit 40*a* connected to trough 39. Recirculation assembly 40 can further include a filter module 40*d* connected to pump 40*b* which can remove solid contaminates from solution 6, as well a heat exchanger 40*e* which can rapidly regulate the temperature of solution 6. Recirculation assembly 40 is effective to recirculate solution 6 to a recirculating supply means (not shown) which is associated with entry port 14.

Thus, with the mechanism illustrated in FIG. 1, guide member 21 assures that solution 6 applied from solution entry port 14 is delivered into a vicinity of nip portion 19 and forms beads 6*a*, 6*b*. The formation of bead 6*a* assures that metering roller 15 will be maintained in a wet state with solution 6, while the formation of bead 6*b* in the vicinity of nip portion 19 assures that photosensitive material 7 delivered to nip portion 19 will be evenly and consistently coated with solution 6.

Figure 3:
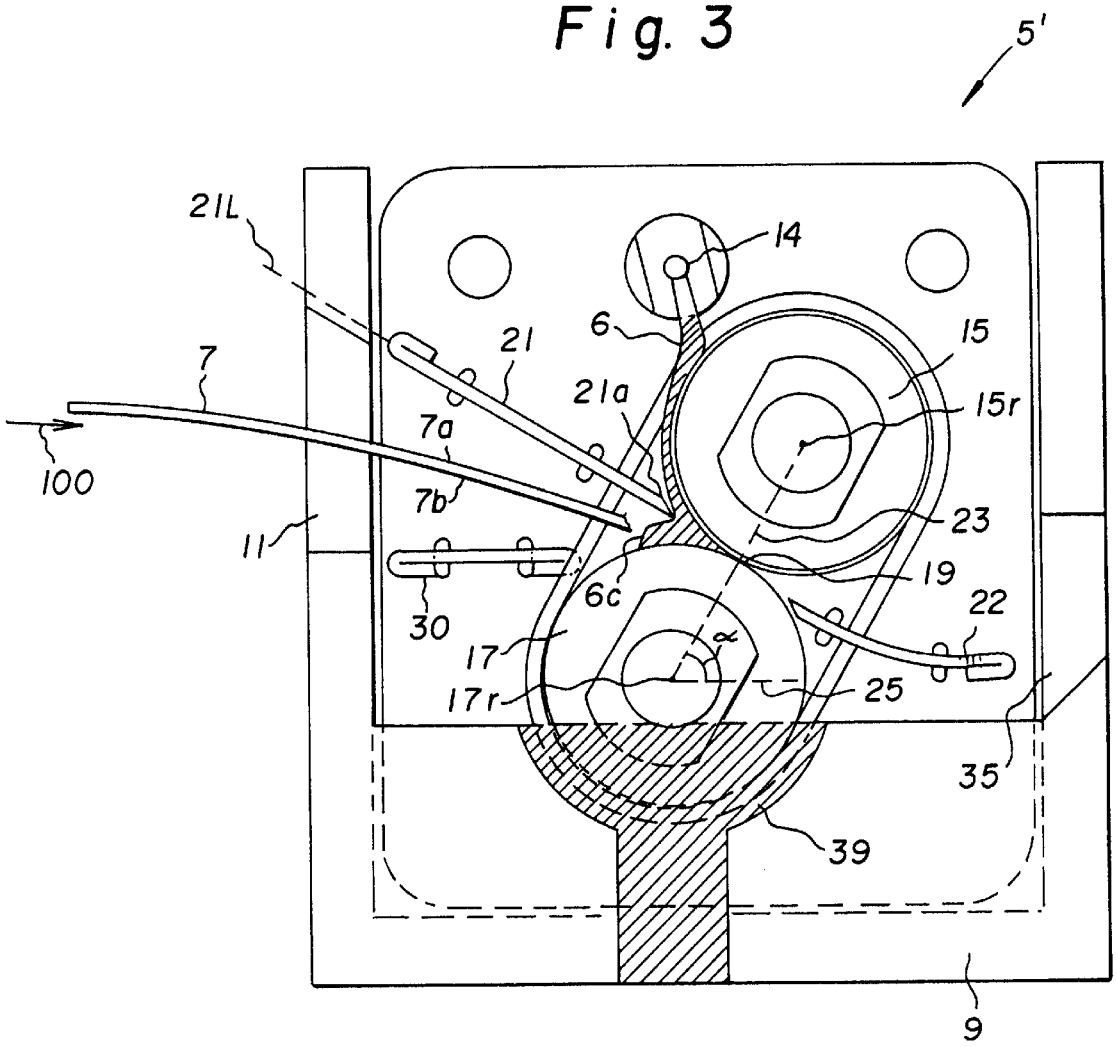
FIG. 3 is a schematic illustration of a further example of the apparatus of the present invention.

FIG. 3 illustrates a second embodiment 5' of the apparatus of the present invention. As illustrated in FIG. 3, in this embodiment viscous solution supply port 14 supplies solution 6 directly onto roller 15, such that solution 6 flows along the outer periphery of roller 15 to a vicinity of nip portion 19 between rollers 15 and 17. Guide member 21 is positioned such that it will guide and maintain solution 6 at nip portion 19 and form a bead 6*c* in a vicinity of nip portion 19. Thus, with the arrangement of FIG. 3, roller 15 is maintained in a wet state due to the application of viscous solution 6 onto roller 15, while bead 6*c* is positioned in a vicinity of and in front of nip portion 19 with respect to conveying direction 100 of photosensitive material 7. This arrangement assures that photosensitive material 7 entering apparatus 5' will be lead into bead 6*c* and thereafter to nip portion 19. This provides for an even and consistent coating of photosensitive material 7 with solution 6.

The remaining features and mode of operation of coating apparatus 5' as illustrated in FIG. 3 with respect to, for example, metering, recirculating, drying, etc. is the same as described with reference to FIG. 1.

Figure 4:
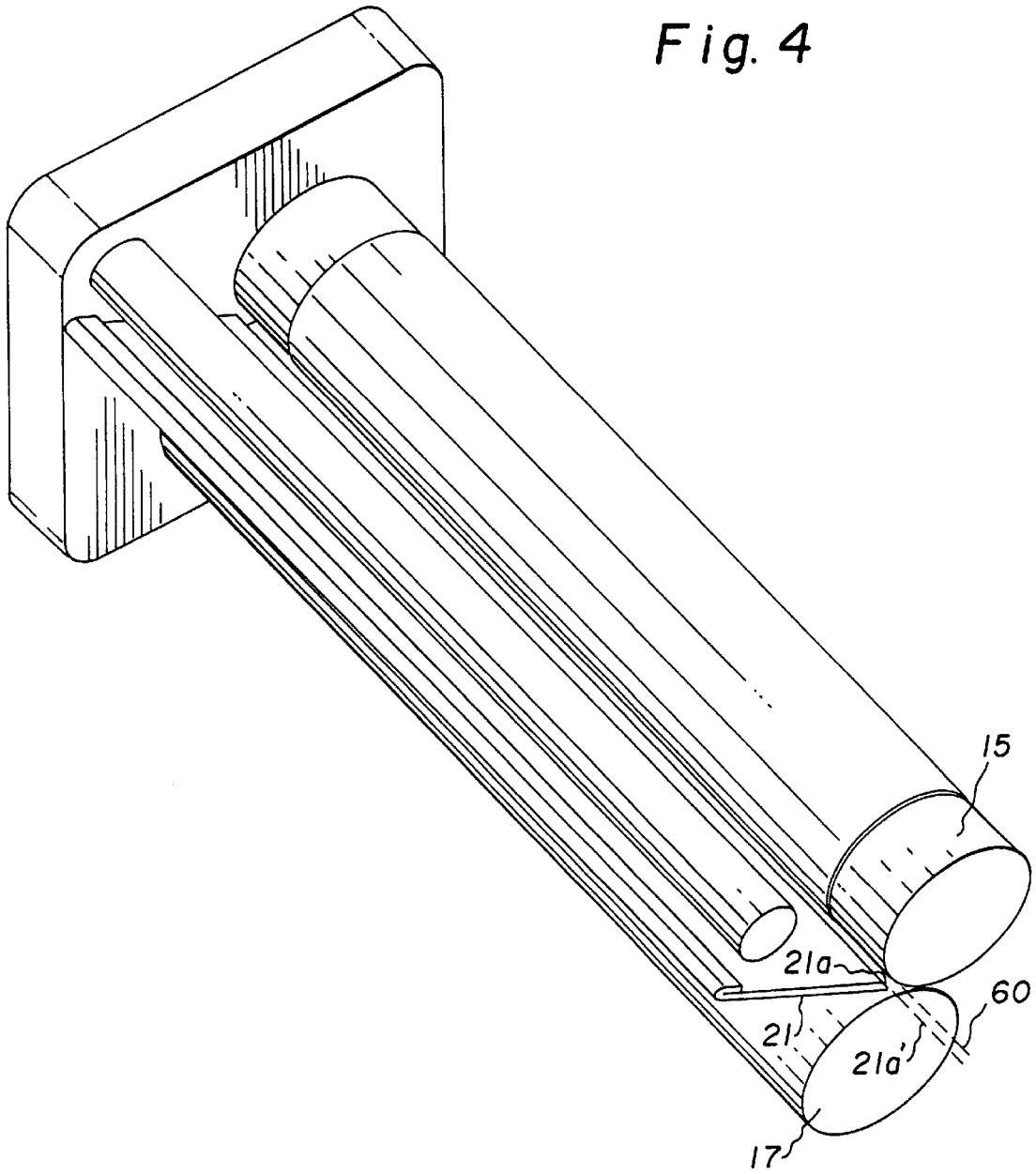
FIG. 4 is an isolated view of a solution supply guide member and drive rollers applicable to the apparatus of FIGS. 1 and 3.

In a further feature of guide member 21 as illustrated in FIGS. 1–4, end 21*a* defines a slanted flat surface. Slanted flat surface of end 21*a'* is spaced from an outer periphery of roller 15 by a distance which assures the formation of first bead 6*a* and second bead 6*b* as described with reference to FIG. 1; and bead 6*c* as described with reference to FIG. 3. Furthermore, as shown in FIG. 4, slanted flat surface of end 21*a* extends along a line 21*a'* which is substantially parallel to a line 60 that is tangent to the outer peripheral surface of roller 15 and faces slanted flat surface of end 21*a*. This applies to the embodiments of FIGS. 1 and 3. In a preferred embodiment of the invention as illustrated in FIG. 4, a distance between slanted flat surface of end 21*a* and line 60 which is tangent to the outer peripheral surface of roller 15 is within the range of approximately 0.5 to 1.5 mm. This range as well as the placement of rollers 15, 17 and guide member 21 as shown in FIGS. 1 and 3 promotes the formation of beads 6*a*, 6*b* of FIG. 1 and bead 6*c* of FIG. 3 as previously described. It is recognized that the present invention is not limited to the range described above, and that depending on design considerations, such as the type or viscosity of solution applied, the range could be varied.

The invention has been described in detail with particular reference to certain preferred embodiments thereof, but it will be understood that variations and modifications can be effected within the spirit and scope of the invention.

What is claimed is:

1. A method of applying at least one solution of a predetermined viscosity to photosensitive material, the method comprising the steps of:

providing a solution supply guide member at a position relative to a first metering roller and a second roller such that one end of said guide member extends toward a nip portion between said first and second rollers, said first and second rollers are oriented such that a center line which connects a center of rotation of said first roller to a center of rotation of said second roller, forms an angle of approximately 30 degrees with a horizontal line such that a bead of a processing solution can be formed in the vicinity of a nip portion between said first and second rollers;

supplying a solution of a predetermined viscosity onto said guide member so that said solution flows along said guide member and is guided toward said nip portion between said first and second rollers, so as to form at least one metered bead of said solution; and conveying a photosensitive material toward said nip portion, such that said solution is applied to a surface of said photosensitive material.

2. A method according to claim 1, wherein:

said step of supplying a solution of a predetermined viscosity onto said guide member permits a formation of said at least one bead and a further bead;

one of said at least one bead and said further bead is formed above said guide member and extends between said guide member and an upper roller of said first and second rollers;

the other of said at least one bead and said further bead is formed in a vicinity of said nip portion and extends below the guide member and between said guide member and a lower roller of said first and second rollers; and said photosensitive material is conveyed into said other of said at least one bead and said further bead.

3. A method according to claim 2, wherein said one of said at least one bead and said further bead maintains an outer peripheral surface of said upper roller wet with said solution, and said other of said at least one bead at said further bead maintains said solution in a vicinity of said nip portion, so as to provide for a constant application of said solution onto said photosensitive material.

4. A method according to claim 1, wherein said guide member has a longitudinal axis which is approximately perpendicular to said center line.

5. A method according to claim 1, wherein said photosensitive material is a processed photosensitive material.

6. A method of applying at least one solution of a predetermined viscosity to photosensitive material, the method comprising the steps of:

providing a solution supply guide member at a position relative to a first metering roller and a second roller so that one end of said guide member extends toward a nip portion between said first and second rollers, said first and second rollers are oriented such that the center line which connects a center of rotation of the first roller to a center rotation of the second roller forms an angle of about 30 degrees with the horizon such that the bead of a processing solution may be retained at a nip between said first and second rollers;

supplying a solution of a predetermined viscosity onto one of said first and second rollers such that said solution flows along an outer peripheral surface of said one of said first and second rollers in a direction toward said one end of said guide member, and is guided by said guide member toward said nip portion, wherein said solution guided by said guide member toward said nip portion forms a metered bead in a vicinity of said nip portion; and conveying a photosensitive material toward said bead and into said nip portion, such that said solution is applied to said photosensitive material.

7. A method according to claim 6, wherein said guide member has a longitudinal axis which is approximately perpendicular with said center line.

8. A method according to claim 6, wherein said one roller of said first and second rollers is a metering roller and the other roller of said first and second rollers is a pinch roller.

9. A method according to claim 6, wherein said one end of said guide member comprises a slanted surface which faces said one roller of said first and second rollers and is spaced from said one roller of said first and second rollers.

10. A method according to claim 6, wherein said photosensitive material is a processed photosensitive material.

11. A method of applying at least one solution of a predetermined viscosity to photosensitive material, the method comprising the steps of:

providing a solution supply guide member at a position relative to first and second rollers such that one end of said guide member extends toward a nip portion between said first and second rollers, said first and second rollers are oriented such that a center line which connects a center of rotation of said first roller to a center of rotation of said second roller forms a predetermined angle with a horizontal line such that a bead of a processing solution can be formed in the vicinity of a nip portion between said first and second roller, wherein said guide member has a longitudinal axis which is approximately perpendicular to said center line;

supplying a solution of a predetermined viscosity onto said guide member so tat said solution flows along said guide member and is guided toward said nip portion between said first and second rollers, so as to form at least one bead of said solution; and conveying a photosensitive material toward said nip portion, such that said solution is applied to a surface of said photosensitive material.

12. A method of applying at least one solution of a predetermined viscosity to photosensitive material, the method comprising the steps of:

providing a solution supply guide member at a position relative to first and second rollers so that one end of said guide member extends toward a nip portion between said first and second rollers, said first and second rollers are oriented such that a center line which connects a center of rotation of said first roller to a center of rotation of said second roller forms a predetermined angle with the horizon such that a bead of a processing solution may be retained at a nip between said first and second roller, wherein said guide member has a longitudinal axis which is approximately perpendicular with said center line;

supplying a solution of a predetermined viscosity onto one of said first and second rollers such that said solution flows along an outer peripheral surface of said one of said first and second rollers in a direction toward said one end of said guide member, and is guided by said guide member toward said nip portion, wherein said solution guided by said guide member toward said nip portion forms a bead in a vicinity of said nip portion; and conveying a photosensitive material toward said bead and into said nip portion, such that said solution is applied to said photosensitive material.

13. A method of applying at least one solution of a predetermined viscosity to photosensitive material, the method comprising the steps of:

providing a solution supply guide member at a position relative to first and second rollers so that one end of said guide member extends toward a nip portion between said first and second rollers said first and second rollers are oriented such that the center line which connects a center of rotation of the first roller to a center of rotation of the second roller forms a predetermined angle with the horizon such that a bead of a processing solution may be retained at a nip between the first and second rollers supplying a solution of a predetermined viscosity onto one of said first and second rollers such that said solution flows along an outer peripheral surface of said one of said first and second rollers in a direction toward said one end of said guide member, and is guided by said guide member toward said nip portion, wherein said solution guided by said guide member toward said nip portion forms a bead in a vicinity of said nip portion, wherein said one end of said guide member comprises a slanted surface which faces said one roller of said first and second rollers and is spaced from said one roller of said first and second rollers; and conveying a photosensitive material toward said bead and into said nip portion, such that said solution is applied to said photosensitive material.

* * * * *